United States Patent [19]

Kreis

[11] 4,373,472

[45] Feb. 15, 1983

[54] WATER HEATER

[75] Inventor: Philipp Kreis, Munich, Fed. Rep. of Germany

[73] Assignee: GmbH & Co. TRUMA-Geratebau, Fed. Rep. of Germany

[21] Appl. No.: 247,668

[22] Filed: Mar. 26, 1981

[30] Foreign Application Priority Data

Mar. 31, 1980 [DE] Fed. Rep. of Germany ..... 3012548

[51] Int. Cl.[3] ..... F22B 5/00

[52] U.S. Cl. ..... 122/14; 122/23; 126/361; 126/350 R

[58] Field of Search ..... 122/14, 19, 17, 18, 122/23; 126/362, 350 R, 361

[56] References Cited

U.S. PATENT DOCUMENTS

| | | | |
|---|---|---|---|
| 1,689,935 | 10/1928 | Shuell | 122/19 |
| 2,070,535 | 2/1937 | Hansen | 122/119 |
| 2,404,860 | 7/1946 | Miller | 122/14 |
| 2,701,554 | 2/1955 | Rheem et al. | 122/19 |

*Primary Examiner*—Edward G. Favors
*Attorney, Agent, or Firm*—William A. Drucker

[57] ABSTRACT

A water heater has a closed container of approximately circular cross-section, a housing surrounding at least a lower part of the water container, the housing being closed by a base and forming, with the base of the water container, a gas-tight combustion chamber, a lower induction aperture for fresh air, an upper extraction aperture for waste gases, and passages through the water container for inlet and outlet pipes. The improvement is that an annular space connected with the combustion chamber is formed between the housing and the water container. The waste gas extraction aperture and the fresh air induction aperture are located in the housing. One or two box-shaped corner sections, for one or both apertures, adjoin the curved housing and, by means of their side walls, convert the housing in the vicinity of the corner sections into a rectangular shape. A connecting branch to link up with a through-flow unit in the outer wall is provided in one side wall.

8 Claims, 4 Drawing Figures

WATER HEATER

BACKGROUND OF THE INVENTION

The invention concerns a water heater for gaseous or gasified liquid fuels, especially for installation in mobile accommodation such as mobile homes, caravans or in mountain huts or similar small rooms, having a closed water container of approximately circular cross-section, a housing surrounding at least the lower section of said water container, said housing being closed at the bottom by means of a base and forming, in conjunction with the base of the water container, a gas-tight combustion chamber, a lower induction aperture for fresh air and an upper extraction aperture for waste gases and also passages through the water container for inlet and outlet pipes.

THE PRIOR ART

In the case of water heaters fuelled by gas, it is usual for a flame and/or combustion tube to be provided in a cylindrical water container, and with small storage containers, this tube can only be fitted in a straight passage. As a result, the desired heat transfer surface cannot be achieved, especially if the water heater is of small overall height to enable it also to be accommodated easily in small rooms containing domestic furniture.

In order to avoid the technically difficult and expensive passage for the pipe, existing water heaters (BE-PS No. 670 901, U.S. Pat. No. 1,689,935) have a water container which is partly or entirely surrounded by a housing, and the heating gases ascending from out of the combustion chamber flow, also laterally, around this container.

In the case of a further water heater of this type (GB-PS No. 282 277), provision is also made to permit the appliance to be set up in a corner of the room, in order to save space. This is achieved by means of flange extensions projecting sideways from the circular housing to form a seal with the walls of the room, while a cover shaped to fit the corner of the room closes the gaps between the circular appliance and the corner of the room at the top thereof. In this case, the waste gas extraction aperture faces the free corner of the room, to permit the fitting of a connection to the chimney bend. The known types of waste gas ducts do not in fact enable a water heater to be placed close up against an inside wall or the side of an article of furniture unless one is prepared to accept excessively large openings in the wall. With existing appliances, fresh air is drawn in from the room through the base of the housing. This is undesirable and indeed is mostly prohibited in mobile rooms. For this reason, existing water heaters, even if they are equipped with smaller water containers, are not suitable for mobile homes, caravans or similar small rooms.

OBJECT OF THE INVENTION

The object of the invention is to provide a water heater characterised by a simple and, in particular, space-saving design which is none the less highly efficient.

SUMMARY OF THE INVENTION

To meet this requirement, a water heater of the type mentioned above is characterised in accordance with the invention in that an annular space connected with the combustion chamber is formed between the housing and the water container, in that both the waste gas extraction aperture and the induction aperture for fresh air are located in the housing, in that one or two box-shaped corner sections, for one or both apertures, adjoin the curved housing and, by means of their side walls, convert the housing in the vicinity of the corner sections into a rectangular shape, and in that a connecting branch to link up with a through-flow unit in the outer wall is provided in one side wall.

The water container which is suspended into the housing, thereby forming an annular space, has a relatively large boundary surface as compared with the combustion chamber and thus a large heat transfer area, which ensures rapid heating of the water and a high degree of efficiency. It is a simple matter to fit both the waste gas extraction aperture and the fresh air induction aperture, of adequate sizes, in the housing. A box-shaped corner section covering it forms a transfer duct which makes it possible to connect convenient elements in the wall opening, thereby permitting favorable and space-saving positioning of the appliance up against a wall. Because the side walls of the corner section meet the housing at a tangent, a relatively large section of the circumference of the housing can be covered, thereby permitting large passage openings. On the other hand, the connections passing through the hole in the wall can be of significantly smaller cross-section. The corner section is also very suitable for staggering the apertures in the housing relative to the connections and for transforming a rectangular flow duct into a circular one.

The special advantage of a corner section emerges if it combines the two apertures for fresh air and waste gases. As a result, the work of manufacture and assembly is markedly simplified and rendered less expensive, and in addition sealing is made easier. In conclusion, the corner section can also be used to receive and conduct a gas supply pipe to the burner and/or other technical equipment connected with combustion, such as a magnetic valve. Sufficient space can be made for this purpose in the lower part of the corner section, in the fresh air chamber. A base plate, which can be unscrewed, of the corner section can be used as a mounting or base plate for these items of equipment.

By combining several passages through the container for pipe or similar connections in a single aperture in the wall of the container and in the housing, not only is manufacture of the water container and of the housing made less costly, but fitting of these pipe connections is simplified and they can be exchanged at any time without difficulty. The combined connections are best accommodated at one point located in a corner, not occupied by the corner section, of the rectangle formed by the existing corner section. By this means, in spite of its many connections, the water heater in accordance with the invention can be installed and connected up in the smallest and least accessible spaces such as fitted cupboards and the like without difficulty.

BRIEF DESCRIPTION OF THE DRAWINGS

The invention is described in more detail below with reference to a diagrammatic example of embodiment of water heater shown in the drawing, wherein.

DESCRIPTION OF THE PREFERRED EMBODIMENT

Figure 1:
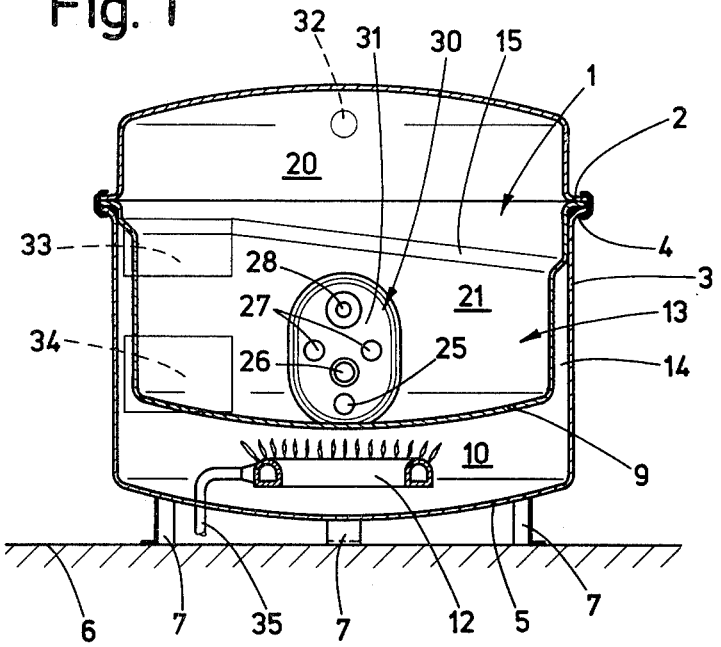
FIG. 1 is a vertical section.

A water heater depicted in FIG. 1 consists of a closed water container 1 with a circumferential flange 2 and a housing 3 which is open at the top where it has a supporting flange 4, while it is closed at the bottom by a curved base 5. The housing rests on feet 7 on the floor 6 of a room. The water container is suspended by its circumferential flange 2 in the housing 3 in such a way that a combustion chamber 10 for a flat gas burner 12 is left between the base 9 of the container and the bottom 5 of the housing. The diameter of the portion 13 of the container suspended in the housing 3 is less than that of the housing, so that an annular space 14 is formed between them, thereby extending the combustion chamber 10. As a result, the hot combustion gases ascend out of the combustion chamber as far as the upper closure. In the example shown, this closure is formed by a step 15 in the wall of the water container, which is widened as far as the housing. For the proper extraction of the combustion gases, this step slopes upwards in the direction of the outlet, thereby preventing an accumulation or blockage of gas in the annular space. At the same time, this step also helps to centre the water container in the housing 3 when these two walls are placed one inside the other to form a good fit and to be fluid-tight.

It is advisable for the housing 3 and the water container 1 to be made of steel sheet. The bases are curved, preferably in the shape of the bottoms of ordinary boilers. For stress reasons, a circular cross-section is advantageous. In the embodiment shown, a larger section of the container is suspended in the housing, while a low upper section of the container rises like a dome above the circumferential flange 2 to form a cupola on the container. In this case, it is desirable for the water container to be divided along the circumferential flange 2 so that the container then consists of two boiler bottoms 20, 21, placed together back to back.

Figure 2:
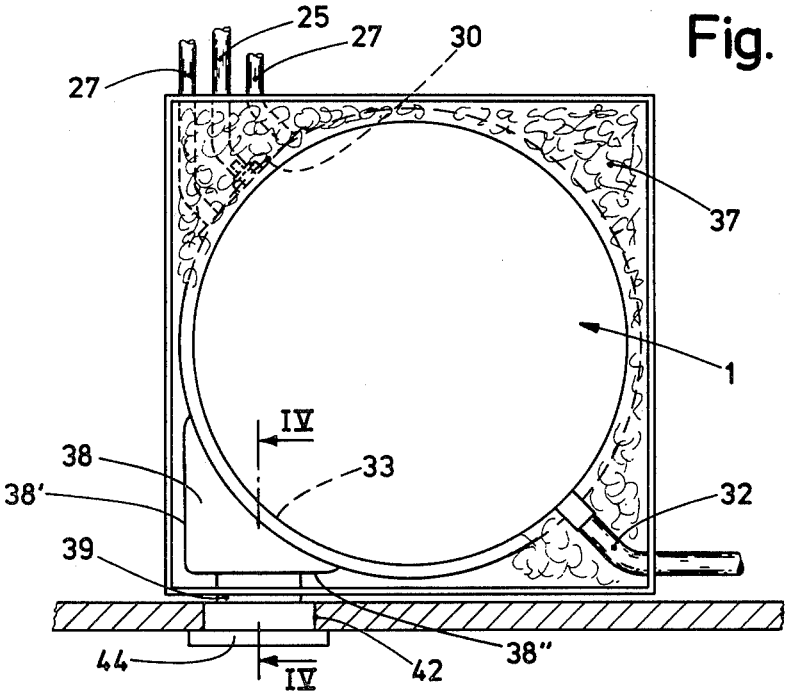
FIG. 2 is a view of the appliance from above, but with connections located at other points and surrounded by an insulating jacket from which part of the insulating material has been removed.

Fresh air is supplied to the gas burner 12 through an induction aperture 34 formed in the housing below the waste gas extraction aperture 33. A gas pipe 35 to the burner leads at a suitable point into the combustion chamber; in FIG. 1, this is through the base 5. FIG. 2 shows the water heater as seen from above. It is surrounded by a heat insulating jacket 37 which is of cubical shape to conform to the conditions of installation. For maximum space utilisation, a connection aperture 30 for the supply connections is located in a resultant corner; for greater clarity, this is not shown in FIG. 1.

In another of these corner spaces, there is a box-shaped corner section 38 placed against the housing 3, the purpose of which is to provide a link between the apertures 33 and 34 and the openings 42 in the wall. To achieve this, the cross-section of the corner section is so designed that it converts the circular shape of the cross-section of the housing into a rectangle. Its side walls 38' and 38" are thus approximately tangential to the housing, a relatively large part of the circumference of which is covered, and in consequence the apertures 33, 34 can also be large.

Located on the side wall 38" of the corner section adjoining the hole 42 in the wall are the connections 39, 40, which can be inserted into the connecting apertures of a through-flow unit or of a box 44 on the outside of the wall containing the fresh air and waste gas ducts. An intermediate plate 41 in the corner section separates the waste gas passage from that for fresh air. The corner section which, in height, does not extend significantly beyond the upper and lower edges of the apertures 33, 34 covered by it, naturally has an airtight closure at the top and bottom. It should preferably have a detachable base plate 41' through which the gas supply pipe 35' can lead via the fresh air chamber 36 to the gas burner 12.

By means of additional mountings or similar devices, which are not shown in further detail, additional fittings necessary for combustion, such as magnetic valves, etc., can be mounted on this base plate or on the side walls of the corner section. This results in a considerable simplification of the assembly and connection of the water heater.

In order that the flows of waste gas and fresh air can always be kept apart between the outer wall and the combustion chamber, provision is also made for a guide plate 43, linking up with the intermediate plate 41, which projects into the combustion chamber.

Figure 3:
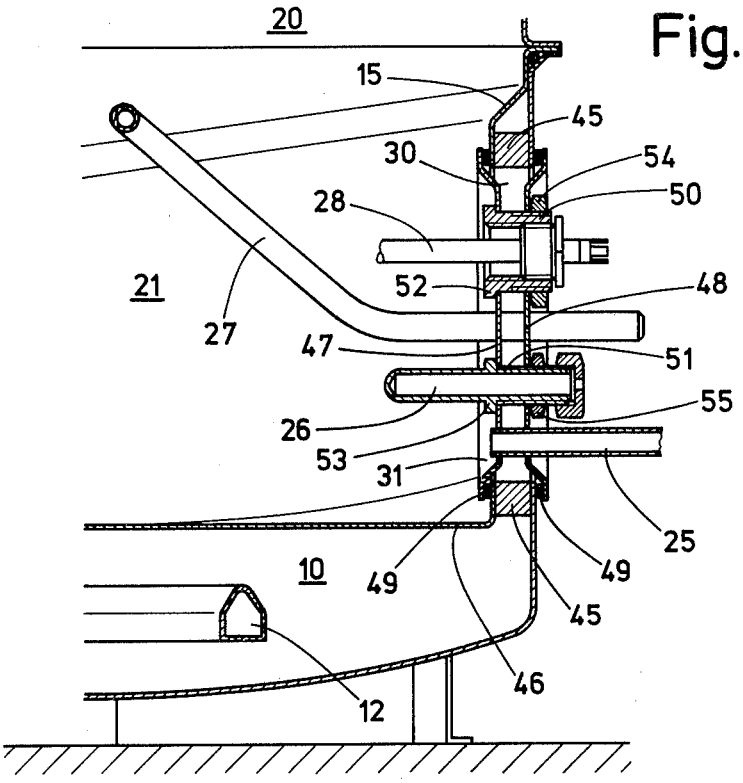
FIG. 3 is a vertical section through a side wall with aperture and cover.
Figure 4:
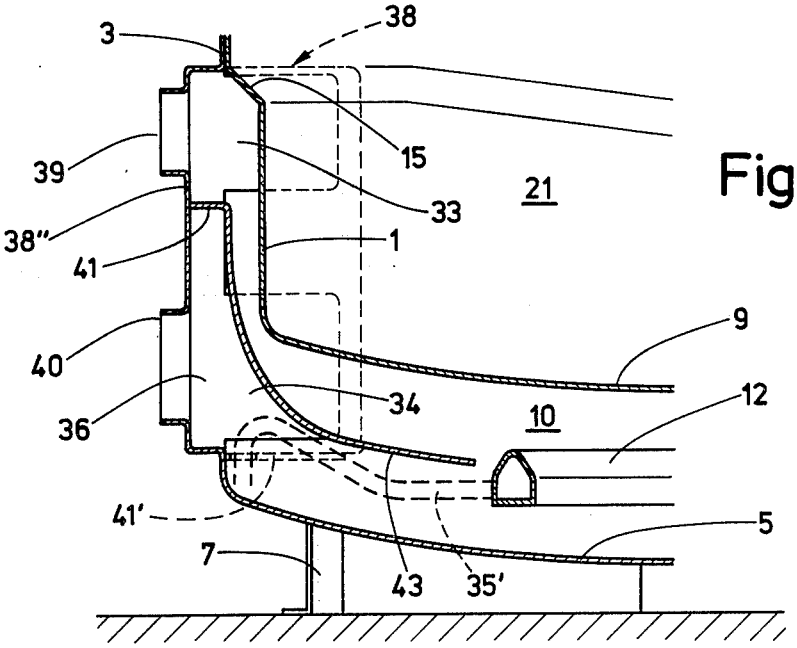
FIG. 4 is a vertical section through a fresh air and waste gas corner section.

A connection aperture 30 (FIG. 3) is provided in the water container and in the housing for inserting a water supply 25 and any further connections which may be required, such as, for example, an immersion tube 26 for a thermostat, a circulating pipe 27 for the heating medium and an additional electric heating rod 28. This connecting aperture, which can also serve as a working opening for enamelling the inside of the container, is closed by a cover 31 (FIG. 3). An advantageous form of cover is shown in FIG. 3. Here, the gap between the wall 46 of the container and the housing 3 is bridged by a spacer 45, preferably of metal, which encloses the entire connection aperture 30. The cover 31 is made up of the two closing plates 47, 48, one of which is pressed from inside against the wall of the container and the other from outside against the housing, preferably with an intermediate heat-resistant sealing ring 49.

In order to brace the two closing plates together and to press them firmly against the walls of the aperture, there are provided threaded rings 50 and 51 which grip the inner plate 47 with the aid of an inside collar 52, pass through the two plates and are secured on the outside by a threaded nut 54 or 55. These threaded rings are preferably so designed that they can be used for connections for, for example, a heating rod 28 or a thermostat immersion tube 26.

The connection aperture 30 is preferably oval in shape, to permit the larger closing plate 47 to be inserted through it. The inside closing plate is forced with increasing internal pressure against the wall of the container, thereby improving the seal. The circulating pipe 27 for the heating medium shown in FIG. 3 can be linked to a fresh water container, thus enabling the fresh water to be pumped through the circulating pipe in order to prevent freezing of the water in the fresh water container.

A bleeding pipe 32 is provided for drawing off water. It is also possible for this pipe to pass through the cover 31 into the water container and to be led upwards therein.

The invention is not limited to the example of embodiment illustrated. For example, it is also possible for two box-shaped corner sections to be allocated to two connection points, each for a waste gas and a fresh air supply pipe, although this would involve additional cost. Furthermore, these two corner sections should only be circumferentially staggered if the outside pressure conditions at the ends of the two ducts do not differ significantly.

I claim:

1. In a water heater for gaseous or gasified liquid fuels, especially for installation in mobile accommodation such as mobile homes, caravans or in mountain huts or similar small rooms, having a closed water container of approximately circular cross-section, a housing surrounding at least the lower section of said water container, said housing being closed at the bottom by means of a base and forming, in conjunction with the base of the water container, a gas-tight combustion chamber, a lower induction aperture for fresh air and an upper extraction aperture for waste gases and passages through the water container for inlet and outlet pipes, the improvement which comprises an annular space connected with the combustion chamber formed between the housing and the water container, both the waste gas extraction aperture and the fresh air induction aperture being located in the housing, one or two box-shaped corner sections having side walls and an outer wall portion in one side wall for one or both apertures having a fresh air chamber, adjoining the housing and, by means of their side walls, converting the housing in the vicinity of the corner sections into a rectangular shape, and a connecting aperture to link up with a through-flow unit in the outer wall portion being provided in one side wall.

2. A water heater, in accordance with claim 1, wherein the fresh air induction aperture is formed underneath the waste gas extraction aperture, said two apertures being enclosed by a corner section which is divided by an intermediate plate, and wherein, on one side wall of the corner section, two connections are provided to join up with a box on the outside wall containing the fresh air and waste gas ducts.

3. A water heater, in accordance with claim 2, wherein the intermediate plate of the corner section is extended by a guide plate projecting into the combustion chamber.

4. A water heater, in accordance with claim 1, wherein the corner section has, in its fresh air chamber equipment for inserting and securing fittings.

5. A water heater, in accordance with claim 1, wherein near the base of the water container, there is formed in the wall of the container and in the housing a connection aperture which can be closed by means of a cover consisting of a closing plate, which can be pressed from inside against the wall of the container, and of a closing plate which can be pressed from outside against the housing, these closing plates being braced by threaded rings which form the passages for the pipe connections.

6. A water heater, in accordance with claim 5, wherein the connection aperture is surrounded by a spaced which seals off the annular space formed between the wall of the container and the housing.

7. A water heater, in accordance with claim 1, wherein the connection aperture is located in a corner, not occupied by the corner section, of a rectangle formed by an existing corner section.

8. A water heater, in accordance with claim 1, wherein to form the annular space between the housing and the water container, the latter has a step in the part suspended in the housing, the unstepped part of the container resting, forming a seal, in the upper opening in the housing.

* * * * *